United States Patent [19]

Skelton et al.

[11] Patent Number: 5,065,608

[45] Date of Patent: Nov. 19, 1991

[54] HAND-OPERATED BATTEN SEAMER TOOL

[76] Inventors: Stuart P. Skelton, 2302 Legge Rd.; Clifford W. Skelton, 2302B Legge Rd., both of Mount Vernon, Wash. 98273

[21] Appl. No.: 569,934

[22] Filed: Aug. 20, 1990

[51] Int. Cl.[5] ..... B21D 5/16

[52] U.S. Cl. ..... 72/409; 72/451; 29/243.58; 81/90.1

[58] Field of Search ..... 81/90.1, 90.2, 91.1, 81/345; 72/409, 410, 450, 381, 384; 29/243.58; 52/468

[56] References Cited

U.S. PATENT DOCUMENTS

| | | | |
|---|---|---|---|
| 2,688,553 | 9/1954 | Demler, Sr. | 72/410 |
| 2,944,262 | 7/1960 | Richman et al. | 72/409 |
| 3,166,960 | 1/1965 | Roessler | 72/384 |
| 3,771,482 | 11/1973 | Thompson . | |
| 4,090,390 | 5/1978 | Barinaga | 72/410 |
| 4,192,115 | 3/1980 | Yamamoto | 52/468 |
| 4,275,584 | 6/1981 | Kruschel | 72/410 |
| 4,324,031 | 4/1982 | Isenhoff | 29/243.58 |
| 4,372,022 | 2/1983 | Puckett | 29/243.58 |
| 4,545,234 | 10/1985 | Schnellmann | 72/410 |
| 4,559,805 | 12/1985 | McClure | 72/384 |

FOREIGN PATENT DOCUMENTS

| | | | |
|---|---|---|---|
| 1094327 | 12/1960 | Fed. Rep. of Germany | 72/409 |

*Primary Examiner*—David Jones

*Attorney, Agent, or Firm*—Christensen, O'Connor Johnson & Kindness

[57] ABSTRACT

A hand-operated batten seamer tool (30) for folding a pair of opposed standing seams (96) over to a pair of double seams. A pair of arms (38) pivotally mounted to a common pivot point (50) to rotate a pair of arms (38) pivotally mounted to a batten cap plate (36) that rests on the batten cap (90). Force applied to the handles (32) is transmitted through a force multiplying mechanism comprising upper link arms (78), side plates (76) and lower link arms (80). A pair of cleats (70) engages the seams (96) during the folding operation to hold the batten seamer tool (30) in engagement with the batten cap (90) and support block (88) to form a pair of tight and leakproof batten seams (86).

4 Claims, 4 Drawing Sheets

HAND-OPERATED BATTEN SEAMER TOOL

TECHNICAL FIELD

The present invention relates to portable hand-operated folding machines, and, more particularly, to a hand-operated batten seamer tool for folding a pair of opposed standing seams over to a pair of double seams.

BACKGROUND OF THE INVENTION

Metal roofs are typically formed from the joining of a plurality of metal panels. In order to give the metal panels rigidity and strength and to provide an appealing appearance, upstanding ribs or battens are sometimes formed where the panels are joined together.

In a typical batten construction, illustrated in FIGS. 1A–C, a pair of panels 10 and 12 are placed on each side of a support block 14. Each panel 10 and 12 has upstanding sides 16 and short, outwardly projecting flanges 18 that are substantially coplanar with the top 20 of the support block 14. A third metal panel formed of a flat sheet is placed over the support block 14 to form a batten cap 22. The opposed outer edges 24 of the batten cap 22 are folded over the flanges 18 to form a pair of opposed standing seams 26. The standing seams 26 are then folded downward to bear against the upstanding sides 16 to form a pair of double seams 28. In this manner the batten cap 22 is firmly held to the panels 10 and 12 with a leakproof seam.

The step of bending a standing seam 26 over to a double seam 28 has typically been performed by large machines that are rolled along the batten seam. A series of progressively angled rollers are used to form the bend on the roof panel. Other machines that are supported on wheels have utilized hand or powered crimping tools that are aligned over the proposed seam by rolling the machine down the batten. The disadvantage of these machines is that they are large and cumbersome, making them difficult to quickly move along the roof or from one roof to another, requiring the aid of several people to either lift and move the machine or disassemble the machine transport the individual parts to another roof.

One drawback with using a portable tool is the light weight makes it difficult for the tool to be firmly held on the panel as a seam is folded over. The usual results is that the tool is forced upward off the panel prior to the seam being fully folded over. This also results in the panel rising up off the support block, compromising the structural integrity of the roof. Another drawback is portable tools are designed to fold over standing seams one at a time, which requires twice the effort and time to fold over the two seams that are present on a batten construction.

SUMMARY OF THE INVENTION

The present invention provides a hand-operated batten seamer tool for folding a pair of opposed standing seams formed from a batten cap and two panels over to a pair of double seams. The tool comprises a pair of handles, each having a mounting end and a gripping end, the mounting end being concentrically mounted to pivot about a common axis. The handles are mounted to a bracing means in the form of a flat bar that braces the tool on the batten cap and also holds the batten cap down onto the supporting structure. A pair of elongate arms are pivotally mounted to the bracing means and have planar faces for bearing against the standing seams.

A force multiplying means in the form of a lever arrangement couples the arms to the pair of handles. Gripping members in the form of elongate cleats mounted on the planar faces of the arms hold the arms in engagement with the pair of standing seams as the arms pivot to fold the pair of standing seams over to a pair of double seams.

In the representative embodiment of the invention, movement of the gripping portion of the handles downward in the direction of the seams forces the arms into engagement with the standing seams to fold the standing seams over to double seams. Biasing means in the form of a spring can be used to urge the handles in an upward direction, thus keeping the tool in a configuration that is ready for use.

As will be readily appreciated from the foregoing description, the present invention provides for a portable hand-operated batten seamer tool that readily engages and grips the opposed pair of standing seams on a batten cap and maintains the tool in engagement with the batten cap as the standing seams are folded over to a pair of double seams. The mounting of the handles such that movement towards the seams forces the arms to fold the seams over results in the force applied by an operator being transferred to the batten cap, and, thus, urging the batten cap against the batten support block to insure a tight seam is formed. Finally, the gripping members on the planar faces of the arms maintain the tool in engagement with the standing seams and the batten cap to further facilitate forming of tight seams.

BRIEF DESCRIPTION OF THE DRAWINGS

The foregoing and other features and advantages of the present invention will become more readily appreciated as the same becomes better understood by reference to the following detailed description when taken in conjunction with the accompanying drawings wherein.

DETAILED DESCRIPTION OF THE PREFERRED EMBODIMENT

Figures 1A, 1B, 1C:
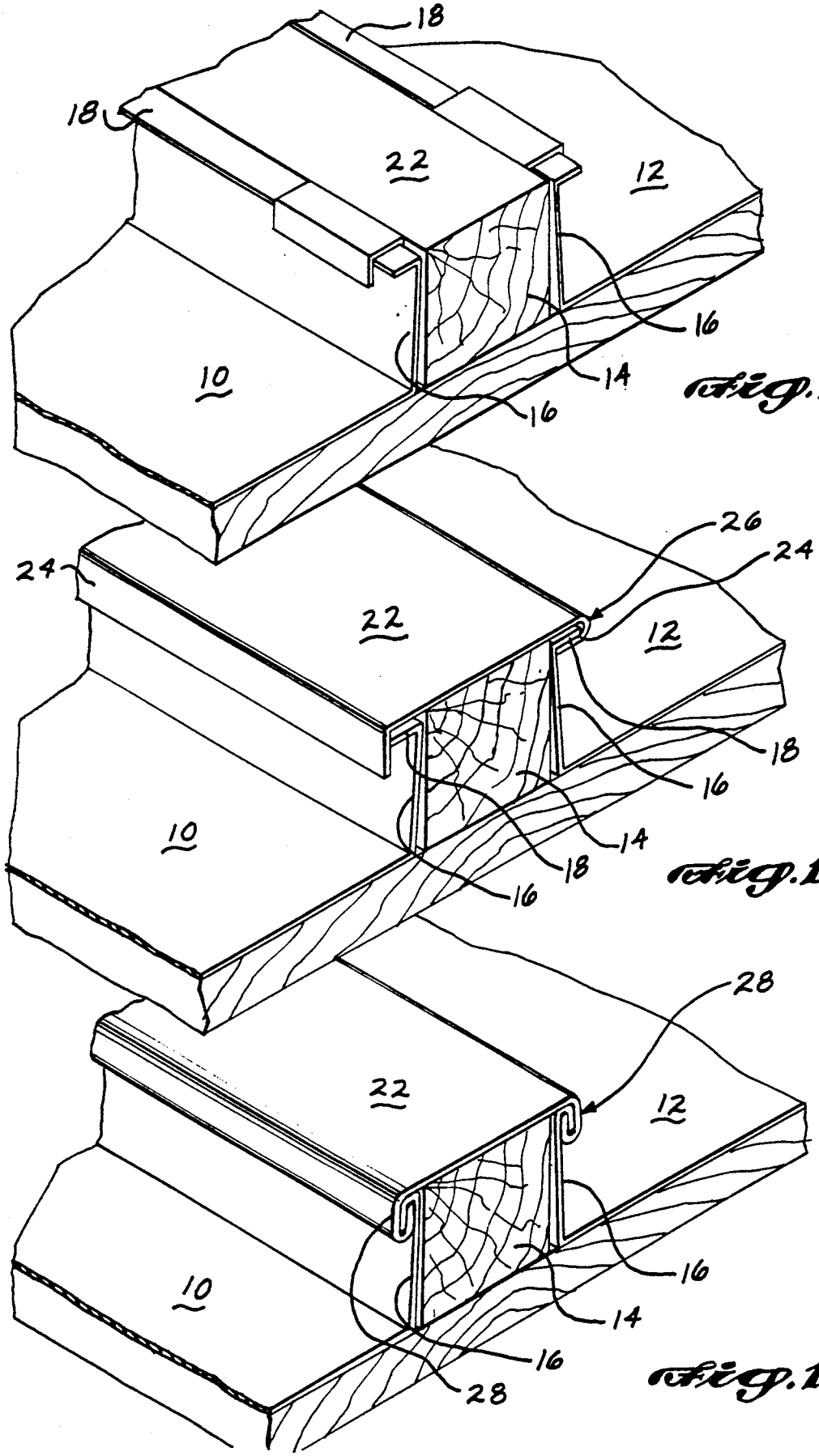
FIGS. 1A–C are a series of isometric views showing the formation of a batten seam.

Referring initially to FIG. 1, the batten seamer tool 30 includes a pair of handles 32, an extension member 34, a batten cap plate 36, and a pair of arms 38. The handles 32, as shown in the representative embodiment, include a gripping end 40 and a mounting end 42. The gripping end 40 is constructed of flat bar stock having a hand grip 44 formed over the end thereof. The mounting end 42 comprises a fork member 46 formed from two pieces of bar stock 48 welded to the sides of the handles 32. The bar stock 48 on one fork member 46 is offset to allow insertion of the fork member 46 from the other handle 32 to permit the handles 32 to be concentrically mounted about the pivot point 50 on the extension member 34. The fork members 46 are rigid and strong to accomodate the loads exerted during the seaming operation.

The extension member 34 is preferably formed from flat bar stock that has one end attached to the batten cap plate 36. In the embodiment shown in FIG. 1, the batten cap plate includes a top surface 52 and a planar bottom surface 54 and a reinforcing member 56. The reinforcing member 56 and the batten cap plate 36 are formed from flat bar stock 48 with the reinforcing member 56 attached to the top surface 52, preferably by welding, so that the reinforcing member 56 is standing upright on one of its narrow sides to prevent longitudinal bending of the batten cap plate 36 and provide a rigid mounting for the extension member 34. A resilient pad 58 constructed from rubber or other similar material is attached to the bottom surface 54 of the batten cap plate with suitable adhesive to provide an abrasion-free bearing surface when the tool 10 is placed on the batten cap. A pair of L-shaped arms 38 constructed from typical angle iron are pivotally attached at their vertex to the narrow sides 60 of the batten cap plate 36 to pivot about an axis that is substantially parallel to the axis about which the handles 32 pivot. In the embodiment shown in FIG. 1, door hinges 62 have been used to pivotally attach the arms 38 to the batten cap plate 36.

The arms 38 include a first leg 64 and a second leg 66 formed at substantially right angles with respect to each other. The second leg 66 has a planar face 68 to which is attached to a cleat 70. As is shown more clearly in FIGS. 3 and 4, the cleat 70 is adjustably mounted to the second leg 66 to slide laterally back and forth thereon. This permits adjustment in the distance between the bottom of the pad 58 and the edge 72 of the cleat 70 when the tool 30 is placed on the batten cap to accomodate different size seams.

Figure 2:
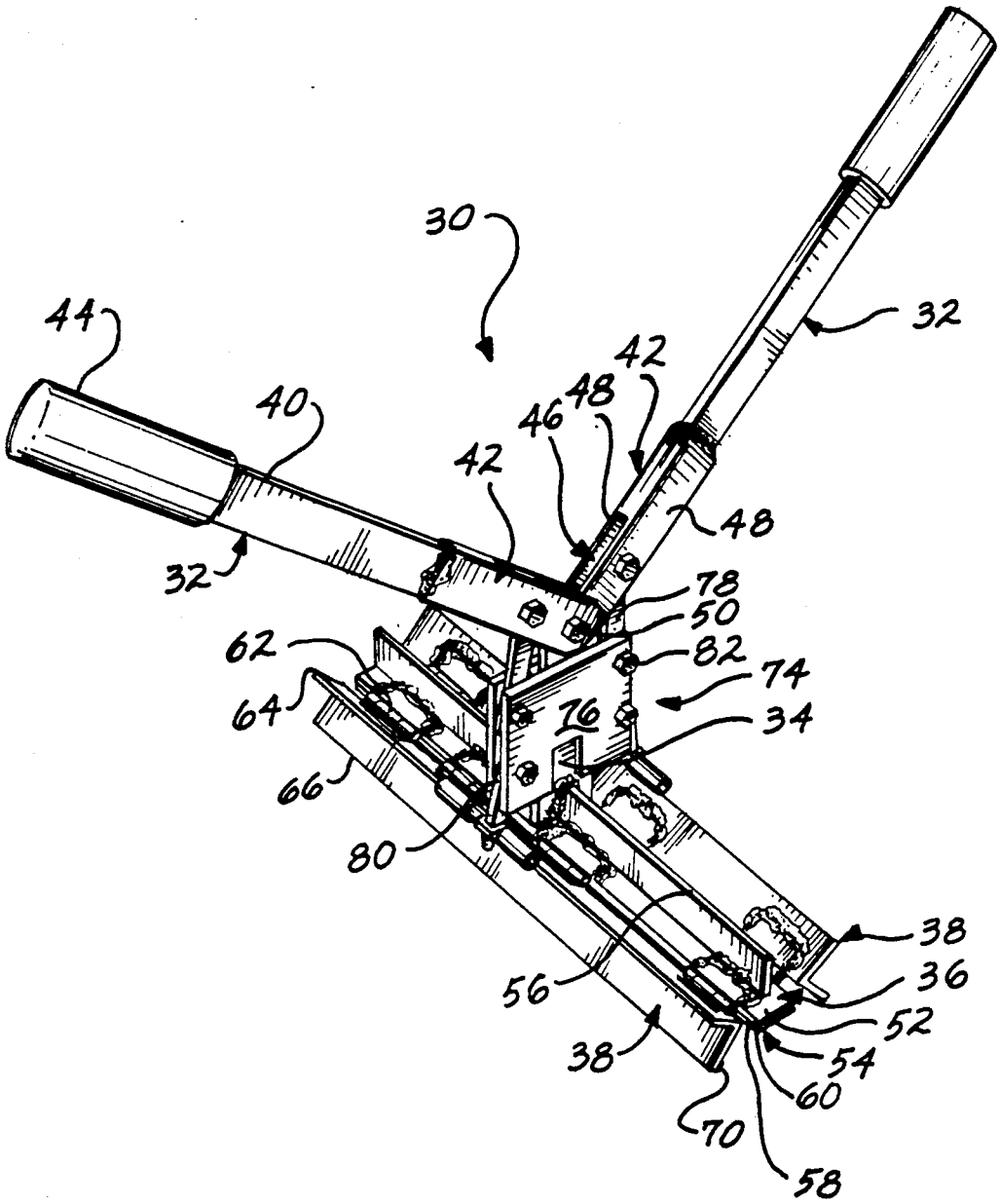
FIG. 2 is an isometric view of a representative batten seamer tool formed in accordance with the present invention.

The first leg 64 of each arm 38 is coupled to the handles 32 through a linkage assembly 74 that includes a pair of side plates 76, a pair of upper link arms 78 and a pair of lower link arms 80. The upper link arms 78 are pivotally attached at one end to the mounting ends 42 of the handles 32 between the pivot point 50 and the gripping ends 40. The other end of the upper link arms 78 are pivotally attached to the pair of side plates 76. The lower link arms 80 are likewise attached at one end to the side plates 76. The lower link arms 80 are attached to the first leg of the arms 38 by a hinge member 84 that is similar in size and shape to the door hinges 62 used on the batten cap plates 36. Ideally, bolts 82 are used to attach the various components together and to function as the axles about which the members pivot. As shown in FIG. 2, the side plates 76 are attached to the link arms 78 and 80 on both sides of the extension member 34.

In this configuration, the handles 32 function as force multiplying members through the principle of leverage. More specifically, the embodiment depicted in FIG. 2 is a second-class lever in that the force or effort applied to the gripping end 40 by an operator to pivot the handles 32 about the fulcrum, pivot point 50, is multiplied at the upper link arms 78 due to the short distance between the upper link arms 78 and the fulcrum, pivot point 50. The resultant multiplied force is transmitted from the upper link arms 78 through the side plates 76 and the lower link arms 80 to the first legs 64, causing the arms 38 to pivot about their hinges 62.

Figure 3:
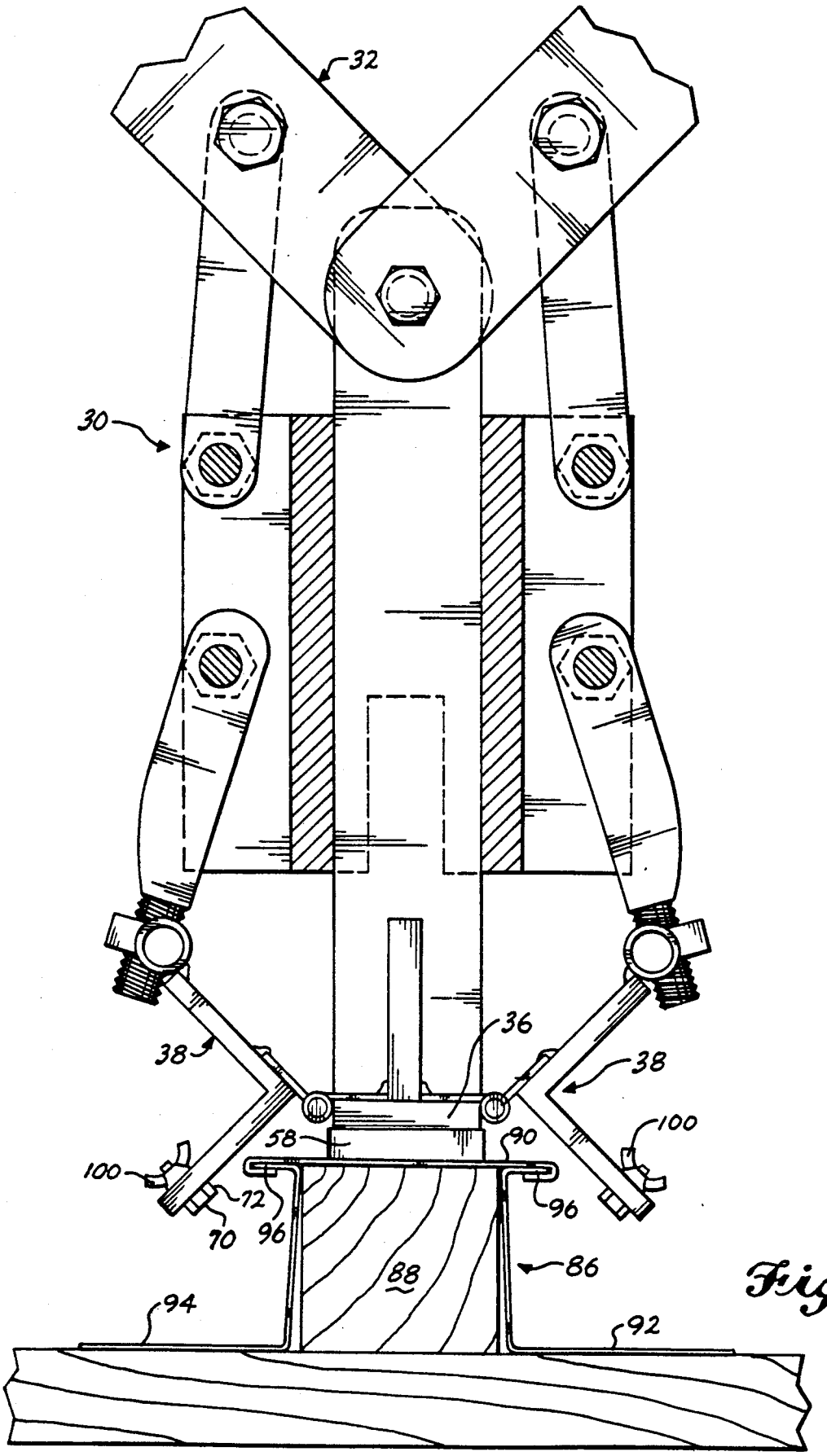
FIG. 3 is a cross-sectional side view of the tool of FIG. 2 showing the batten seamer tool in initial engagement with a batten cap.

The operation of the batten seamer tool 30 will now be described in conjunction with the cross-sectional views depicted in FIGS. 3 and 4. Referring initially to FIG. 3, the batten seam 86 includes the batten support block 88, the batten cap 90 and panels 92 and 94. The edges of batten cap 90 has been folded over the outwardly projecting edges of the panels 92 and 94 to form a pair of oppositely disposed standing seams 96. The batten seamer tool 30 is placed in alignment on the batten seam 86 with the pad 58 resting on the batten cap 90. The handles 32 are in the upward position so that the arms 38 are pivoted upward and spread apart or opened to fit over the batten seam 86. The weight of the tool 30 is resting on the batten cap 90 to hold it against the support block 88.

Figure 4:
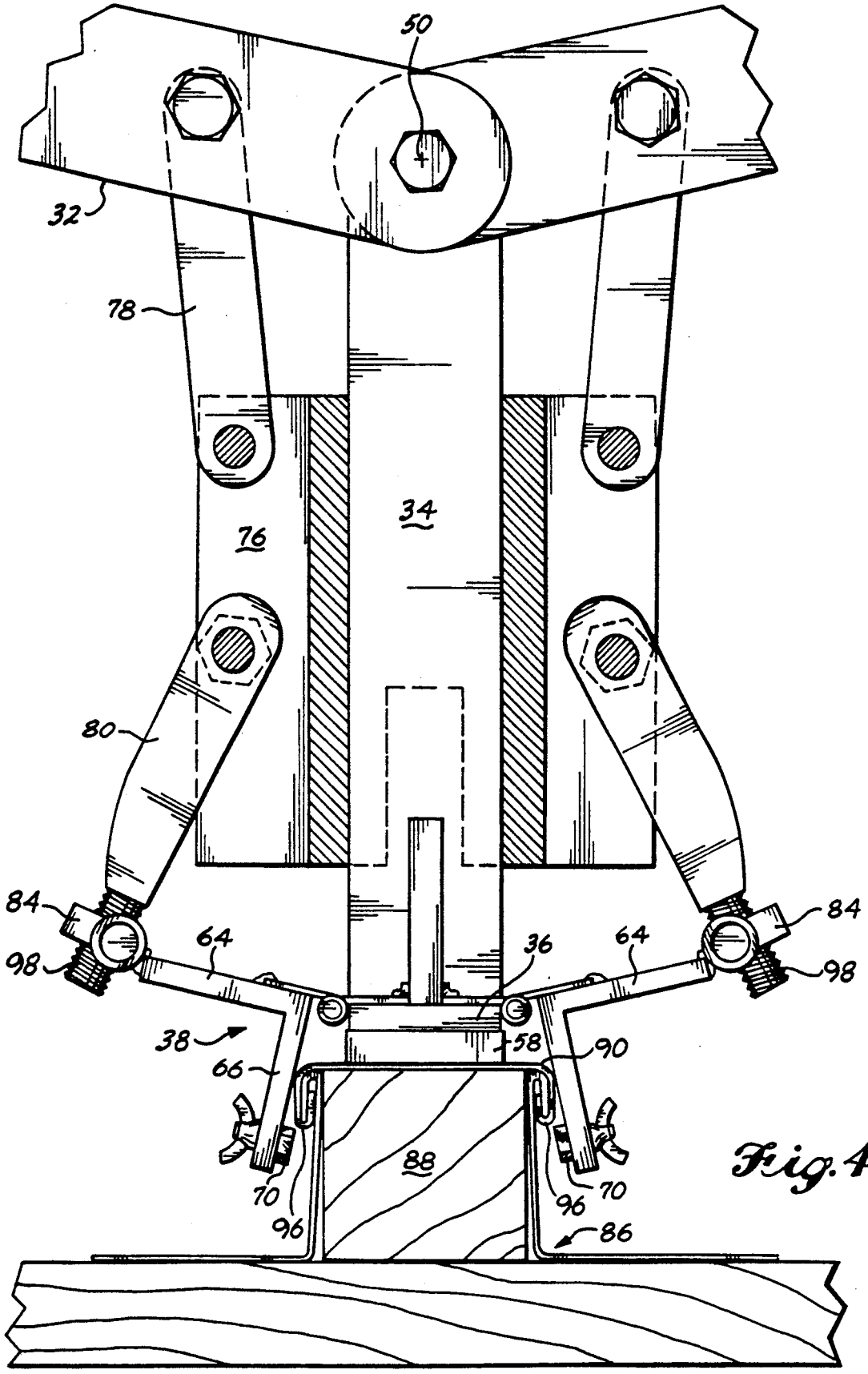
FIG. 4 is a cross-sectional side view of the tool of FIG. 2 showing the formation of the pair of double seams.

In FIG. 4, the handles 32 have been pivoted about the pivot point 50 to be moved downward toward the seams 96. The force exerted by an operator in moving the handles 32 is partially transmitted through the upright extension member 34 to the batten cap plate 36 and pad 58 to firmly hold the batten cap 90 on the support block 88. The balance of the force is multiplied through the principle of leverage as described above and transmitted through the upper link arms 78, the side plates 76, and the lower link arms 80 to the first legs 64, thereby rotating the arms 38 downward towards the batten seam 86. As the arms 38 rotate, the planar faces on the second legs 66 contact the seams 96 and force them to fold downward and towards the support block 88. As the handles 32 reach substantially a horizontal position, the second legs 66 of the arms 38 will reach a substantially vertical position, forcing the seams 96 against the vertical portions of the panels 92 and 94 to form the pair of double seams.

The length of the upper link arms 78 and the lower link arms 80 determines the relative position of the handles 32 and the arms 38 with respect to each other. The lower link arms 80 have threaded ends 98 that are threadably engaged with the hinge members 84 to permit adjustment in the relative position of the arms 38 with respect to the handles 32. In addition, the cleats 70 are mounted such that the upper edge 72 will contact the seam 96 during the folding operation to prevent the tool 10 from slipping upwards and off the batten cap 90 as the seams 96 are folded. The wing nuts 100 permit rapid adjustment in the lateral position of the cleats 70. Thus, the cleats 70 help to maintain the cap plate 36 and pad 58 in firm contact with the batten cap 90 to form a tight and leakproof batten seam 86.

Although a preferred embodiment of the invention has been illustrated and described it is to be understood that various changes and modifications may be made therein without departing from the scope of the claims appended hereto. For instance, a spring member may be used to urge the handles 32 upward such that the arms 38 are held in an open position as shown in FIG. 3. Consequently, the invention may be practiced otherwise than as illustrated and described herein.

The embodiments of the invention in which an exclusive property or privilege is claimed are defined as follows:

1. A hand-operated batten seamer tool for folding a preformed pair of opposed standing seams on a batten cap over to a pair of double seams, the tool comprising:

a pair of handles, each handle having a mounting end and a gripping end;

means for bracing the tool on the batten cap and for holding the batten cap to supporting structure;

a pair of elongate arms pivotally mounted to said bracing means, the arms having elongate planar faces for bearing against the standing seams;

a force multiplying means coupling the arms to the pair of handles; and, gripping members mounted to the planar faces of the arms that engage the pair of standing seams to hold the arms in engagement with the standing seams as the arms pivot to fold the pair of standing seams over to a pair of double seams.

2. The tool of claim 1, wherein the gripping members are adjustably mounted on the planar faces of the arms to facilitate engagement with any size of standing seams.

3. The tool of claim 1, wherein the pair of handles are mounted so that movement of the gripping end of the handles towards the arms causes the arms to pivot into engagement with the pair of standing seams to fold the standing seams over to double seams.

4. The tool of claim 3, wherein the gripping members are adjustably mounted to the planar faces of the arms.

* * * * *